United States Patent [19]

West et al.

[11] Patent Number: 4,585,361

[45] Date of Patent: Apr. 29, 1986

[54] ACTUATOR FOR DOT MATRIX PRINTHEAD

[75] Inventors: Daniel A. West, Santa Clara; Lawrence S. Nyi, San Jose, both of Calif.

[73] Assignee: Dataproducts, Inc., Woodland Hills, Calif.

[21] Appl. No.: 769,668

[22] Filed: Aug. 26, 1985

Related U.S. Application Data

[63] Continuation of Ser. No. 580,656, Dec. 16, 1984, abandoned.

[51] Int. Cl.[4] ..... B41J 3/12

[52] U.S. Cl. ..... 400/124; 29/89.5; 29/434; 29/445; 29/602 R; 335/276; 101/93.05

[58] Field of Search ..... 400/124; 335/274, 275, 335/276; 101/93.05, 93.48; 29/89.5, 602 R, 434, 445

[56] References Cited

U.S. PATENT DOCUMENTS

| | | | |
|---|---|---|---|
| 335,118 | 2/1886 | Ernst | 29/89.5 |
| 2,492,935 | 12/1949 | McCulloch | 29/89.5 X |
| 2,881,015 | 4/1959 | Wahl | 29/89.5 X |
| 3,071,314 | 1/1963 | Flanagan | 29/89.5 X |
| 3,970,978 | 7/1976 | Langree | 335/276 X |
| 3,991,869 | 11/1976 | Berrey | 400/124 |
| 4,136,978 | 1/1979 | Bellinger | 400/124 |
| 4,338,585 | 7/1982 | Volke | 335/276 X |
| 4,344,055 | 10/1982 | Toda | 335/276 X |

FOREIGN PATENT DOCUMENTS

| | | | |
|---|---|---|---|
| 2935994 | 4/1981 | Fed. Rep. of Germany | 101/93.48 |
| 61589 | 4/1982 | Japan | 400/124 |
| 87969 | 6/1982 | Japan | 101/93.48 |
| 8665 | 1/1983 | Japan | 400/124 |
| 166068 | 10/1983 | Japan | 400/124 |

*Primary Examiner*—Paul T. Sewell

*Attorney, Agent, or Firm*—Spensley Horn Jubas & Lubitz

[57] ABSTRACT

An improved dot matrix actuator is provided which includes a magnetic circuit formed of a yoke assembly and a pivotal armature. The armature is pivotally supported with respect to the yoke by means of a flexure assembly which eliminates the need for a true pivot between the two elements. The elements are shaped so as to maintain a constant small air gap therebetween so as to maximize the magnetic efficiency of the device while eliminating wear. The device is operated just below saturation of the magnetic circuit in order to maximize efficiency. In addition, the actuator includes several features for maximizing its speed and operational efficiency.

6 Claims, 16 Drawing Figures

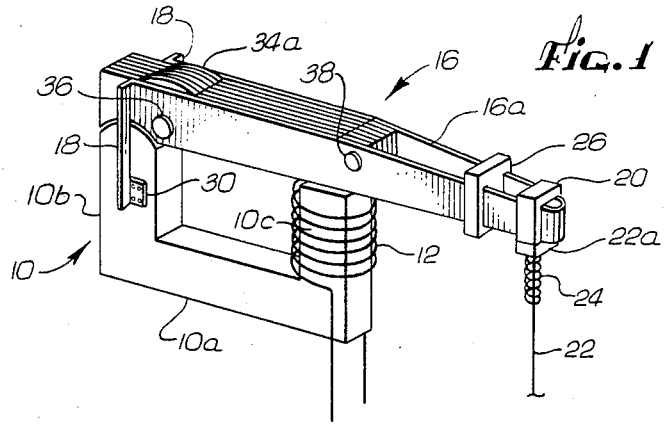
Fig. 1
Fig. 2
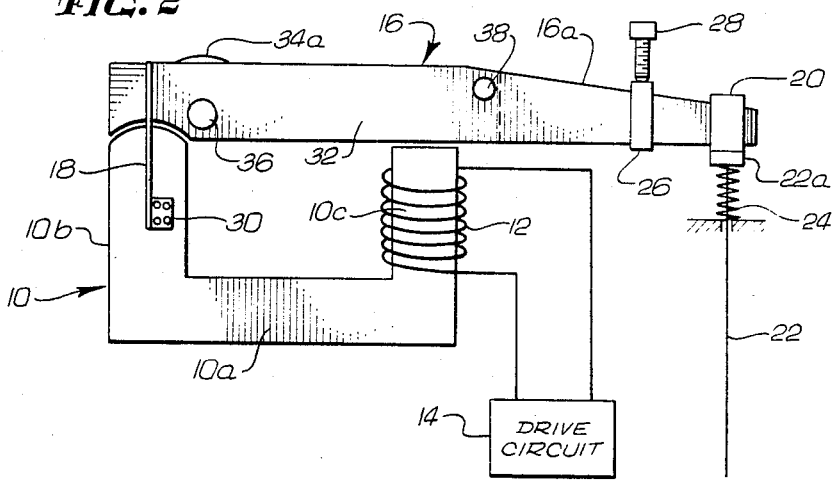
Fig. 3
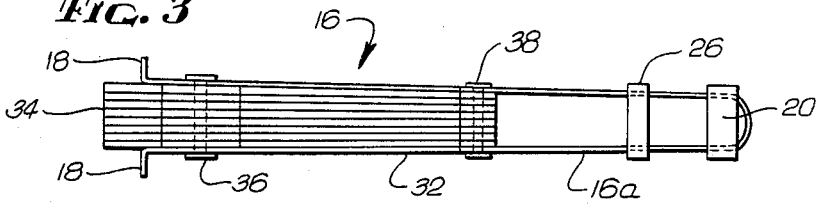
Fig. 4
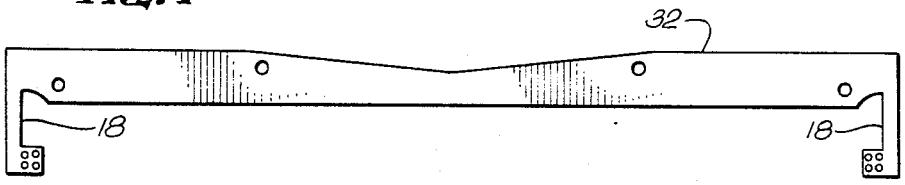

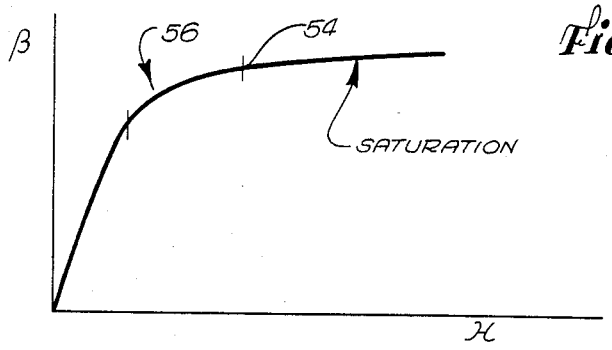
Fig. 10
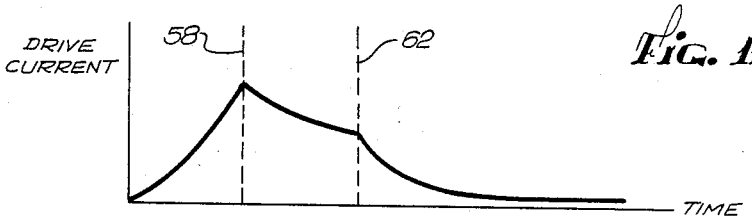
Fig. 11a
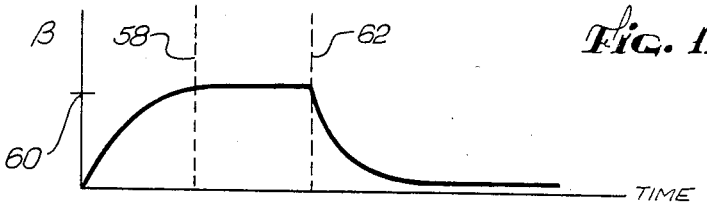
Fig. 11b
Fig. 12
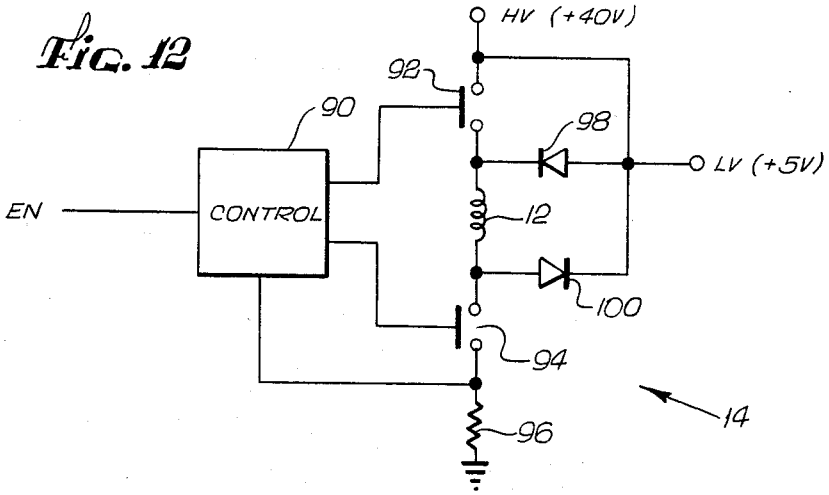

ACTUATOR FOR DOT MATRIX PRINTHEAD

This is a continuation of application Ser. No. 580,656, filed on Feb. 16, 1984,

BACKGROUND OF THE INVENTION

1. Field of the Invention

The present invention relates to dot matrix printheads and more particularly to actuators for such printheads. Still more particularly, this invention relates to actuators for wire matrix printheads in which a plurality of actuators are carried within a body and are employed to drive print wires which extend from the body into contact with a printing medium.

2. Description of the Prior Art

Printers employing wire matrix printheads are characterized in that for each print cycle, the printer does not print an entire character per impact, but instead uses an array of wire styli to print selected combinations of dots serially onto the recording medium so that as the printhead is moved relative to the medium, successive print cycles generate characters. Printheads of this type typically use a separate electromagnetic actuator for each wire stylus within the printhead.

Clapper-type matrix printheads generally include a body containing a plurality of actuators and a guide assembly which supports the wire stylii. Each actuator carried within the body includes a magnetic yoke assembly having a coil wrapped around it and an armature assembly which is movable with respect to the yoke assembly. The armature has a free end which is coupled to a wire stylus. The coil is driven so as to actuate the armature assembly in order to drive its associated stylus to impact a printing medium. A printhead of this type is disclosed in U.S. Pat. No. 4,320,981 to Harrison et al. Other dot matrix actuators are disclosed in U.S. Pat. No. 4,242,004 to Adler, U.S. Pat. No. 4,109,776 to Ek et al. and U.S. Pat. No. 3,968,867 to Stenude. Other types of electromagnetic actuators are disclosed in U.S. Pat. No. 2,998,553 to Moon et al., U.S. Pat. No. 1,998,810 to Getchell and U.S. Pat. No. 3,609,609 to Bertazzi.

Prior art actuators have various problems associated with them, including high inertia, low acceleration, low magnetic efficiency, and high energy consumption. A major factor in the design limitations of actuators is that the armature must serve the dual purpose of carrying sufficient magnetic flux to enable a large magnetic drive force to be achieved yet being rigid and light enough to cope with the stress of the impact and facilitate maximum acceleration.

SUMMARY OF THE INVENTION

The present invention is directed to an improved dot matrix actuator which incorporates several design features to obtain increased efficiency and faster operating speed. The actuator includes a yoke assembly having a base portion and a pair of leg portions and an armature assembly pivotably connected to one of the leg portions and extending past the other leg portion. The armature is connected to the first leg portion by means of a flexure element which serves to maintain the armature spaced from the leg portion in order to eliminate friction between the two elements. In order to achieve maximum magnetic efficiency, the coupling surfaces between the armature and leg portion are rounded so that a constant, minimum air gap is maintained between the armature and leg during pivotal motion.

In order to optimize the magnetic and acceleration characteristics of the armature, the armature includes a first portion of magnetic material extending between the two leg portions and a separate low inertia armature extension which is optimized for sufficient stiffness and high speed operation. In order to achieve maximum acceleration, the cross sectional shape of the first portion of the armature is designed to provide a maximum flux to inertia ratio.

In order to achieve maximum efficiency, the drive circuit and magnetic circuit are matched to provide working flux levels just below saturation. In addition, the drive circuit provides a current waveform which maintains near constant flux during armature motion. This is achieved by reducing the drive current as the armature moves closer to the yoke during cycling.

These and other features are employed in an actuator in order to achieve a substantial overall increase in magnetic efficiency, a reduction in the drive energy requirements, and a decrease in the cycling time of the actuator with a resulting increase in the printing speed capability of the printhead.

BRIEF DESCRIPTION OF THE DRAWINGS

The invention will be described with reference to the accompanying drawings wherein:

FIG. 1 is a perspective view of an actuator according to the present invention;

FIG. 2 is a side plan view of the actuator;

FIG. 3 is a top plan view of the armature of the actuator;

FIG. 4 is a plan view of a metal strap used to form the armature and flexures;

FIG. 10 is a graph showing the BH curve of the magnetic circuit of the actuator;

FIGS. 11*a–b* are graphs illustrating the drive current, and magnetic field of the actuator, respectively;

FIG. 12 is a diagram of a drive circuit for use with the actuator of the present invention;

DESCRIPTION OF THE PREFERRED EMBODIMENT

Figure 5:
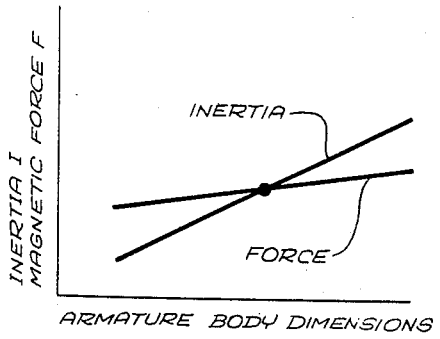
FIG. 5 is a graph illustrating the variation in inertia and magnetic force of the actuator as a function of the armature dimensions.

The following description is of the best presently contemplated mode of carrying out the invention. This description is made for the purpose of illustrating the general principles of the invention and is not intended to be taken in a limiting sense. The scope of the invention is best determined by the reference to the appended claims.

Referring to FIGS. 1 and 2, the actuator of the present invention includes a magnetic yoke assembly 10 having a base portion 10*a* and first and second leg portions 10*b* and 10*c*, respectively. A coil 12 surrounds the second leg portion in order to provide a drive current to produce a magnetic field in the yoke. The current to the coil 12 is supplied by a drive circuit 14.

An armature 16 is pivotally connected to the first leg portion 10*b* by means of a pair of flexure elements 18. The armature passes across the second leg portion 10*c* and includes a low inertia, high ridigity armature extension 16*a* extending beyond the leg portion 10*c*. A plastic tip 20 is secured to the end of the armature extension and impacts against the head 22*a* of a wire stylus 22. The stylus is biased toward the armature by means of a spring 24. An additional plastic block 26 is located toward the middle of the armature extension 16*a* and serves to provide a contact surface for an adjustment screw 28. The screw 28 may be adjusted to control the amount of travel of the armature.

In operation, the yoke 10 and armature 16 form a magnetic circuit. When current is passed through the coil 12, the armature 16 will be pivoted with respect to the leg portion 10*b* and attracted toward the leg portion 10*c*. The flexures 18 serve to maintain the armature spaced from the leg 10*b* in order to avoid friction. The flexure pivotally supports the armature and does not interfere with the magnetic circuit between the armature and the yoke. In order to achieve maximum magnetic efficiency, the upper surface of the leg 10*b* has a cylindrical curvature and the mating surface of the armature has a corresponding cylindrically curved indentation. As a result, a constant air gap will be maintained between the yoke and armature as the armature pivots. This is to be contrasted with prior art systems in which the armature typically contacts the yoke and does not maintain a constant air gap. Such a system is shown in U.S. Pat. No. 4,244,658. This patent discloses a rounded yoke extension; however, the armature contacts the extension and rolls with respect to it. A constant air gap is thus not maintained, and friction is present.

The size of the air gap is on the order of one-half of a mil. This small air gap is achieved by initially constructing the device so that the armature contacts the yoke extension. The device is then operated for a run-in period so that the two surfaces rub against each other, eventually wearing down and forming the gap. After the elements have worn against each other, the flexures 18 serve to precisely maintain the relative position of the armature and extension while preventing them from touching one another. Thus, the air gap is self forming and will be maintained at the absolute minimum amount necessary, thereby achieving maximum efficiency for the magnetic circuit.

In the present embodiment of the invention, the flexures 18 are formed of stainless steel and are secured to the yoke extension 10*b* at point 30. For small angles of rotation (less than about 5 degrees) movement of the flexure is analogous to rotation about the center of the flexure. The center of the flexure is positioned at the center of radius of the end of the extension 10*b*. The use of the flexures avoids the need for a true pivot and thus reduces wear on the actuator by eliminating friction.

The flexure configuration is such that it is not stressed when the actuator is closed. When the actuator is open, the flexure is bent slightly and biases the armature toward the closed position. This bias force counteracts the spring force of the print wire spring 24, thus decreasing the force needed to actuate the actuator. This is beneficial since it enables a somewhat higher spring force spring to be employed, with a corresponding increase in the natural frequency of the spring. This in turn enables the speed of operation of the actuator to be increased, since the system vibration will die out more quickly. Thus, the torsional spring function of the flexures maintains a low actuating force requirement while enabling a print wire spring of relatively high natural frequency to be employed.

Referring now to FIG. 3, the armature assembly 16 is a dual section assembly in which both its magnetic circuit properties and inertia properties are optimized. The armature is defined by a metal strap 32 (FIG. 4) which is formed into a U-shaped configuration within which is carried an armature body 34. The structure is held together by means of pins 36 and 38. In the preferred embodiment of the invention, the body section 34 is a laminated structure of magnetic material. The laminations serve to reduce eddy currents within the armature. The armature extension 16*a* is a hollow section and thus has very low mass. In addition, the armature extension 16*a* is oriented so that the edge of the strap 32 faces the print wire, thereby maximizing the rigidity of the armature. The extension 16*a* does not carry any magnetic flux and is thus optimized for low inertia and sufficient stiffness in order to achieve high speed operation. In contrast, the body section is designed to provide optimum magnetic circuit operation. In this regard, it is noted that the body section includes a hump 34*a* (FIGS. 1 and 2) which corresponds generally to the opening for the pin 36 and serves to maintain the cross sectional area of the body section constant.

In the preferred embodiment of the invention, the flexure elements 18 are integrally formed with the armature strap 32. The flexure elements are simply bent forward 90 degrees and thus do not have to be separately attached to the armature. The use of this structure greatly simplifies the manufacture of the actuator.

Figure 6:
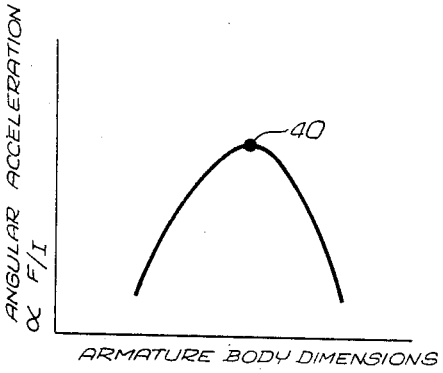
FIG. 6 is a graph illustrating the angular acceleration of the armature as a function of the armature dimensions.

Referring now to FIGS. 5 and 6, the dimensions of the armature body 34, particularly the cross sectional area, are chosen so that the armature is optimized for maximum acceleration. As shown in FIG. 5, as the armature body dimensions increase, the magnetic force developed in the body will also increase. However, due to an increase in the mass that accompanies the increase in dimensions, the inertia of the body will also increase.

The angular acceleration of the armature will increase as the magnetic force increases and decrease as the inertia increases and is therefore proportional to force over inertia. FIG. 6 represents the change in angular acceleration with respect to changes in the armature body dimensions. The armature body dimensions are chosen to maximize the angular acceleration of the armature, i.e., so that they correspond to the point 40 on the curve of FIG. 6. These dimensions are determined experimentally.

Figure 7:
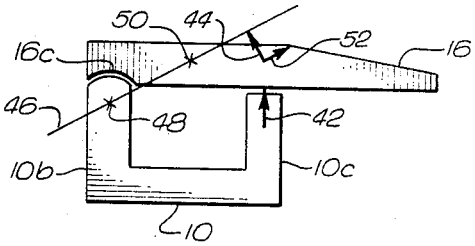
FIGS. 7–9 are diagrammatic illustrations of actuators illustrating reaction forces developed in the actuator.
Figure 8:
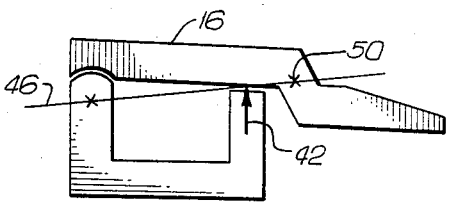
Figure 9:
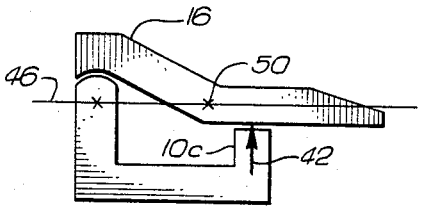

Referring now to FIGS. 7–9, when the actuator strikes the extension 10*c* of the yoke assembly, a reaction force will be developed which is perpendicular to the face of the extension. This reaction force is indicated by an arrow 42 in FIG. 7. This force is against the armature 16 and can be divided into a component 44 which is perpendicular to a line 46 through the pivot point 48 and center of mass 50 of the armature and a component 52 which is parallel to the line 46. The component 44 tends to pivot the armature 16 with respect to the point 48, whereas the component 52 tends to translate the armature with respect to the pivot point 48. The rotational motion is acceptable, since that is the designed operation of the armature. However, the translational motion is very undesirable, since it will cause the pivot area 16c of the armature to contact the base of the extension 10b, thus increasing the cycling time of the actuator as well as creating wear problems.

The problems created by the reaction force can be minimized by insuring that the reaction force 42 causes only pivotal motion. This is accomplished by designing the actuator so that the line 46 is substantially perpendicular to the force 42. This is in turn accomplished by controlling the location of the center of mass 50 of the armature. In FIG. 8, the forward end of the armature is lowered with respect to the design shown in FIG. 7 in order to shift the center of mass. Alternatively, a configuration such as that shown in FIG. 9, in which the extension 10c is reduced in height may be employed. Many different configurations are possible, with the fundamental design criteria being to locate the center of mass of the actuator in such a way that the line 46 is perpendicular to the force 42. This should be accomplished without adding unnecessary mass to the forward portion of the armature.

Referring now to FIG. 10, the BH curve (flux density vs. magnetic intensity) of the actuator is illustrated. The magnetic intensity is proportional to the drive current applied to the coil of the actuator. In prior systems, the drive current is such that the actuator is operated well into saturation, i.e., beyond the point 54 in FIG. 10. Although such operation achieves the maximum magnetic intensity, it is inefficient in that an unnecessary amount of drive current is used. In the present invention, the magnetic circuit and drive circuits are matched to provide working flux levels just below saturation, i.e., in the "knee" area indicated at 56 in FIG. 10, in order to achieve maximum operational efficiency. Moreover, this flux level is maintained during forward armature motion by controlling the current waveform provided by the drive circuit shown in FIG. 12.

The drive current is indicated in FIG. 11a, and is related to the magnetic field in FIG. 11b. Upon actuation, the drive current is rapidly increased until it reaches a desired operating point 58. During this period, the magnetic field will increase to the desired operating level indicated at 60 in FIG. 11b and the armature will begin to move. As the armature motion continues, the reluctance of the magnetic circuit formed by the armature and the yoke 10 will decrease, and less current will be required to maintain the same level of magnetic flux. The current therefore is reduced at the rate required to maintain a substantially constant flux level until a point 62. The current is then reduced to zero at a rate which reduces the magnetic flux in a controlled fashion.

The drive circuit is illustrated in FIG. 12. When an enable pulse EN calling for actuation of the actuator is generated, a control circuit 90 will close transistor switches 92 and 94 so as to connect the drive coil 12 between a high voltage source HV and a sensing resistor 96, tied to ground. Current therefore flows though the coil. When the current reaches a predetermined value (2.5 Amps), the voltage across the resistor 96 is sufficient to activate the control circuit 90, which opens switch 92. This occurs at point 58 in FIG. 11a. The current in the coil then becomes controlled by a low voltage supply LV through a diode 98. By chosing LV to overcome just the resistive voltage drops in 96, 94, 12 and 98, the coil current could be maintained constant at the value of switchover from HV to LV.

In practice LV is chosen less than this value so that a current decay commences upon switchover. The most energy efficient choice is to have the current decay at a rate which matches the reluctance decrease in the magnetic circuit as the armature closes. If this is done, the magnetic flux is kept essentially constant, just below saturation, as shown in FIG. 11b. This situation continues for as long as the EN signal is maintained, i.e., about 250 microseconds. At that time (point 62) the switch 94 is opened allowing the discharge of coil current through a diode 100.

Note that the relationship between the current profile and LV is not a direct one, due to the combination of the non-linear characteristic of the diode and the exponential decay of the current in an inductive circuit.

Figure 13:
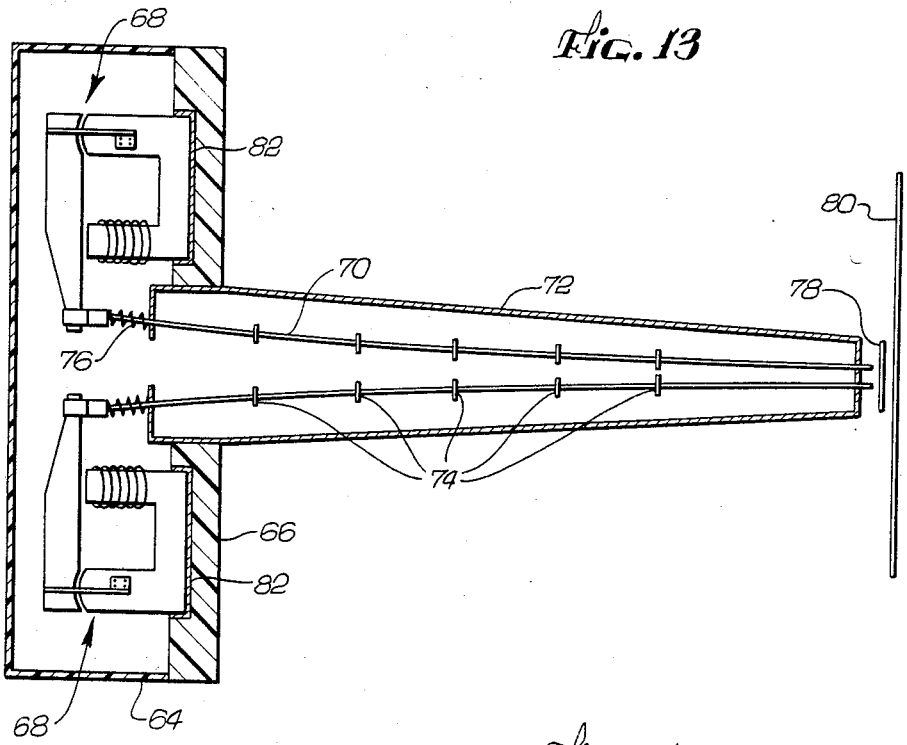
FIG. 13 is a plan view in section of a print head incorporating the actuator of the present invention.

Referring now to FIG. 13, a number of actuators are employed to construct a matrix print head. The printhead is comprised of a main housing 64 having a base section 66 to which a plurality of actuators 68 are attached. Typically, the actuators are arranged in a circular fashion around the housing. Each actuator drives an associated print wire 70 which extends through a printhead extension 72 and is supported by means of a plurality of print wire bearings 74. Each print wire has a print wire spring 76 associated with it as discussed previously. The tips of the print wires extend out of the end of the housing 72 and impact against a inked ribbon and printing medium 78 and 80 in order to accomplish printing.

The actuators 68 are molded into the base section 66, which is typically formed of an epoxy material. In order to minimize the amount of noise produced by the printhead, a thin layer of damping material 82 may be provided between the actuator and the base. This layer of material prevents the generation of noise at the interface between the actuator and the remainder of the printhead.

During operation, the print wires buckle when they impact the ribbon and print medium. This buckling builds up energy which must be dissipated before another dot can be printed, i.e., the print wire must return to its unbuckled condition. In the present invention, the buckling of the print wire itself is used to aid in returning the print wire to its initial configuration. This is accomplished by positioning the bearings 74 so that they are relatively close together near the rear of the extension and leave a relatively long free space near the front of the extension. This forces the print wire to buckle in an area 82 close to the print medium. This buckling near the impacting point acts as a spring which forces the remainder of the print wire back to its initial configuration. This spring action of the print wire helps in overcoming the inertia of the remainder of the print wire. By forcing the print wire to buckle near the printing medium, the effective restoring force is maximized.

Figure 14:
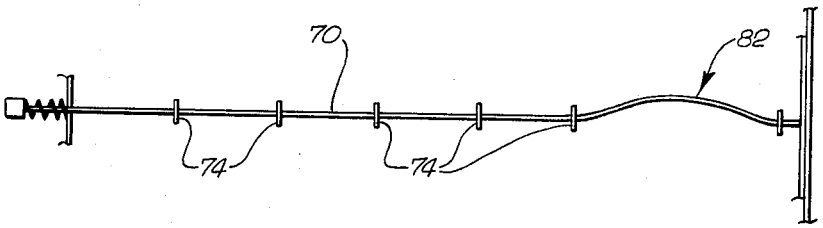
FIG. 14 is a diagrammatic view of a print wire illustrating buckling action upon impact.
Figure 15:
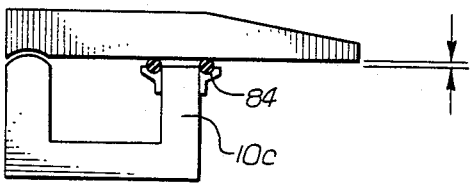
FIG. 15 is a plan view of an actuator including a cushion element for reducing noise generated by the actuator.

In order to further reduce the noise generated by the actuators, a cushion device which has an O-ring 84 may be positioned at the face of the yoke extension 10a as illustrated in FIG. 14. It is believed that most of the noise generated by the actuator is caused by the impact of the armature and the pole face of the extension 10c. By precisely placing an O-ring of damping material around the pole face, the actuator moves normally until just before impact. The armature contacts the O-ring, which prevents the armature from closing the last approximately one-half mil, thus eliminating the metal to metal contact.

Thus, the present invention provides a dot matrix actuator which incorporates several features in order to increase the efficiency, speed, life span and noise characteristics of the device. Although a specific embodiment of the invention has been described, it should be appreciated that many modifications and variations may be made without departing from the scope of the invention. It is therefore intended that the claims cover such modifications and equivalents.

What is claimed is:

1. A method of making an actuator for a wire matrix printer comprising the steps of:

providing a yoke assembly having a base portion and first and second leg portions extending from one side of the base portion, wherein the end of the first leg portion has a rounded surface;

providing an armature assembly having a rounded attachment surface complementary to the rounded surface of the first leg portion;

securing the armature assembly to the yoke assembly so that the rounded attachment surface contacts and conforms to the rounded surface of the first leg portion and so that the armature assembly extends across the second leg portion, the step of securing including providing at least one flexure element extending from the armature assembly to the first leg portion to support the armature assembly for pivotal movement with respect to the first leg portion about a central axis of the rounded surfaces; and pivoting the armature assembly with respect to the first leg portion for a run-in period to cause the rounded surfaces to rub against each other and form a gap therebetween which is maintained by the flexure element.

2. A method according to claim 1 wherein the step of pivoting includes the steps of providing a coil which surrounds a portion of the yoke assembly and repeatedly applying a drive current to the coil to pivot the armature assembly.

3. An actuator made in accordance with the method of claim 1.

4. An actuator according to claim 3 wherein the rounded surfaces are cylindrical.

5. An actuator according to claim 4 wherein there are two flexure elements which are formed of flat metal strips.

6. An actuator according to claim 5 wherein the end of the first leg portion is convex and the attachment surface of the armature assembly is concave.

* * * * *